US006186324B1

(12) United States Patent
Catterson

(10) Patent No.: US 6,186,324 B1
(45) Date of Patent: Feb. 13, 2001

(54) TOOTHBRUSH HOLDING DEVICE

(76) Inventor: Marcia Joy Catterson, 5936 S. Major Ave., Chicago, IL (US) 60638

( * ) Notice: Under 35 U.S.C. 154(b), the term of this patent shall be extended for 0 days.

(21) Appl. No.: 09/512,442

(22) Filed: Feb. 25, 2000

(51) Int. Cl.[7] ..... B65D 83/10

(52) U.S. Cl. ..... 206/362.1; 206/15.2; 220/636; 248/110

(58) Field of Search ..... 206/362, 362.1–362.3, 206/152.2, 15.3; 132/308, 310; 220/630, 632, 636; 211/65–66; 312/209; 248/110

(56) References Cited

U.S. PATENT DOCUMENTS 4,978,003 * 12/1990 Foster ..... 206/362
4,995,511 * 2/1991 Evans ..... 206/362.1
4,997,629 * 3/1991 Marchand et al. ..... 206/362.1
5,474,206 * 12/1995 Herring, Sr. ..... 220/636
5,485,937 * 1/1996 Tseng ..... 220/636
5,522,497 * 6/1996 Stacy ..... 206/362.1
5,630,505 * 5/1997 Garcia ..... 206/362.1
5,660,292 * 8/1997 Scholfield ..... 220/636

* cited by examiner

*Primary Examiner*—Luan K. Bui

(57) ABSTRACT

A toothbrush holding device for holding and covering toothbrushes. The toothbrush holding device includes a housing. The housing has a bottom wall. The bottom wall has a peripheral edge. A peripheral wall is integrally coupled to and extends upwardly from the peripheral edge. The peripheral wall has a top edge. A cover member covers the housing. The cover member has a plate having a peripheral edge. The plate has a plurality of bores therein. The peripheral edge has a lip thereon adapted for removably coupling to the top edge of the peripheral wall.

8 Claims, 5 Drawing Sheets

FIG.1
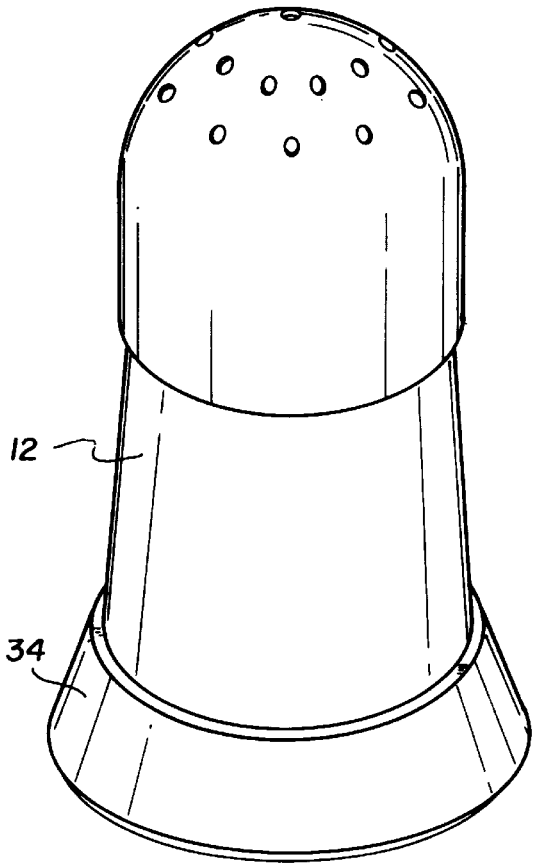
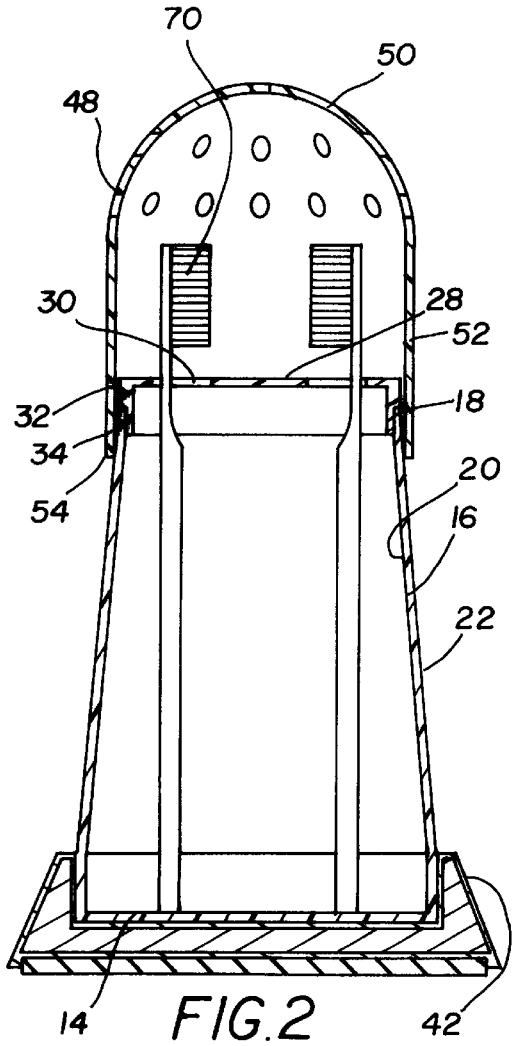
FIG.2

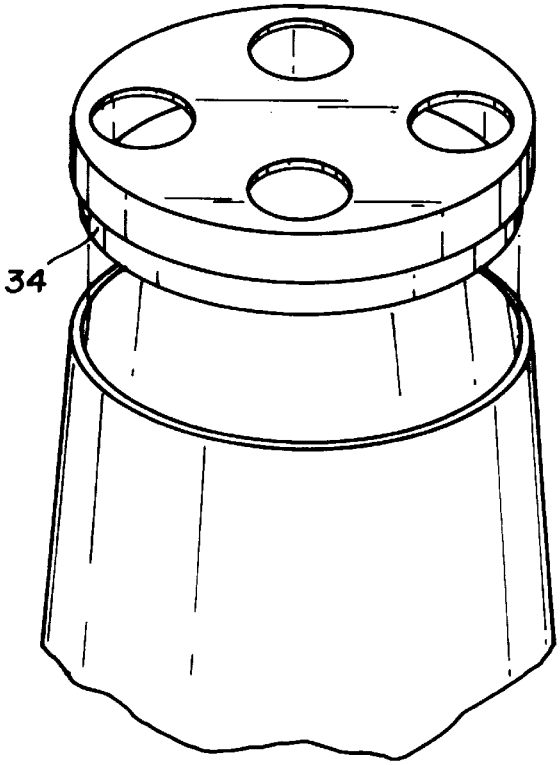
FIG.3
FIG.4
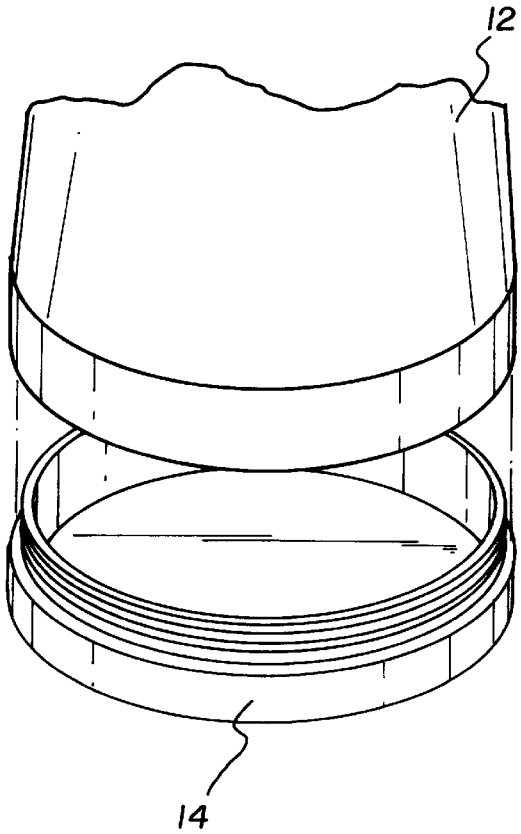

TOOTHBRUSH HOLDING DEVICE

BACKGROUND OF THE INVENTION

1. Field of the Invention

The present invention relates to toothbrush holders and more particularly pertains to a new toothbrush holding device for holding and covering toothbrushes.

2. Description of the Prior Art

The use of toothbrush holders is known in the prior art. More specifically, toothbrush holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,630,505; U.S. Pat. No. 2,280,431; U.S. Des. Pat. No. 370,812; U.S. Des. Pat. No. 314,109; U.S. Des. Pat. No. 324,792; U.S. Des. Pat. No. 336,398; U.S. Pat. No. 5,566,823; U.S. Pat. No. 2,366,876; U.S. Pat. No. 3,884,635; U.S. Pat. No. 5,660,285; U.S. Pat. No. 1,446,520; and U.S. Des. Pat. No. 327,195.

While these devices fulfill their respective, particular objectives and requirements, the aforementioned patents do not disclose a new toothbrush holding device. The inventive device includes a housing. The housing has a bottom wall. The bottom wall has a peripheral edge. A peripheral wall is integrally coupled to and extends upwardly from the peripheral edge. The peripheral wall has a top edge. A cover member covers the housing. The cover member has a plate having a peripheral edge. The plate has a plurality of bores therein. The peripheral edge has a lip thereon adapted for removably coupling to the top edge of the peripheral wall.

In these respects, the toothbrush holding device according to the present invention substantially departs from the conventional concepts and designs of the prior art, and in so doing provides an apparatus primarily developed for the purpose of holding and covering toothbrushes.

SUMMARY OF THE INVENTION

In view of the foregoing disadvantages inherent in the known types of toothbrush holders now present in the prior art, the present invention provides a new toothbrush holding device construction wherein the same can be utilized for holding and covering toothbrushes.

The general purpose of the present invention, which will be described subsequently in greater detail, is to provide a new toothbrush holding device apparatus and method which has many of the advantages of the toothbrush holders mentioned heretofore and many novel features that result in a new toothbrush holding device which is not anticipated, rendered obvious, suggested, or even implied by any of the prior art toothbrush holders, either alone or in any combination thereof.

To attain this, the present invention generally comprises a housing. The housing has a bottom wall. The bottom wall has a peripheral edge. A peripheral wall is integrally coupled to and extends upwardly from the peripheral edge. The peripheral wall has a top edge. A cover member covers the housing. The cover member has a plate having a peripheral edge. The plate has a plurality of bores therein. The peripheral edge has a lip thereon adapted for removably coupling to the top edge of the peripheral wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toothbrush holding device apparatus and method which has many of the advantages of the toothbrush holders mentioned heretofore and many novel features that result in a new toothbrush holding device which is not anticipated, rendered obvious, suggested, or even implied by any of the prior art toothbrush holders, either alone or in any combination thereof.

It is another object of the present invention to provide a new toothbrush holding device which may be easily and efficiently manufactured and marketed.

It is a further object of the present invention to provide a new toothbrush holding device which is of a durable and reliable construction.

An even further object of the present invention is to provide a new toothbrush holding device which is susceptible of a low cost of manufacture with regard to both materials and labor, and which accordingly is then susceptible of low prices of sale to the consuming public, thereby making such toothbrush holding device economically available to the buying public.

Still yet another object of the present invention is to provide a new toothbrush holding device which provides in the apparatuses and methods of the prior art some of the advantages thereof, while simultaneously overcoming some of the disadvantages normally associated therewith.

Still another object of the present invention is to provide a new toothbrush holding device for holding and covering toothbrushes.

Yet another object of the present invention is to provide a new toothbrush holding device which includes a housing. The housing has a bottom wall. The bottom wall has a peripheral edge. A peripheral wall is integrally coupled to and extends upwardly from the peripheral edge. The peripheral wall has a top edge. A cover member covers the housing. The cover member has a plate having a peripheral edge. The plate has a plurality of bores therein. The peripheral edge has a lip thereon adapted for removably coupling to the top edge of the peripheral wall.

Still yet another object of the present invention is to provide a new toothbrush holding device that has a removable cover member for releasing water contained in the housing.

Even still another object of the present invention is to provide a new toothbrush holding device that has a slip resistant sole.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new toothbrush holding device according to the present invention.

FIG. 2 is a schematic cross-sectional view of the present invention.

FIG. 3 is a schematic perspective view of the cover member of the present invention.

FIG. 4 is a schematic perspective view of a second embodiment of the present invention having a removable bottom.

DESCRIPTION OF THE PREFERRED EMBODIMENT

Figure 5:
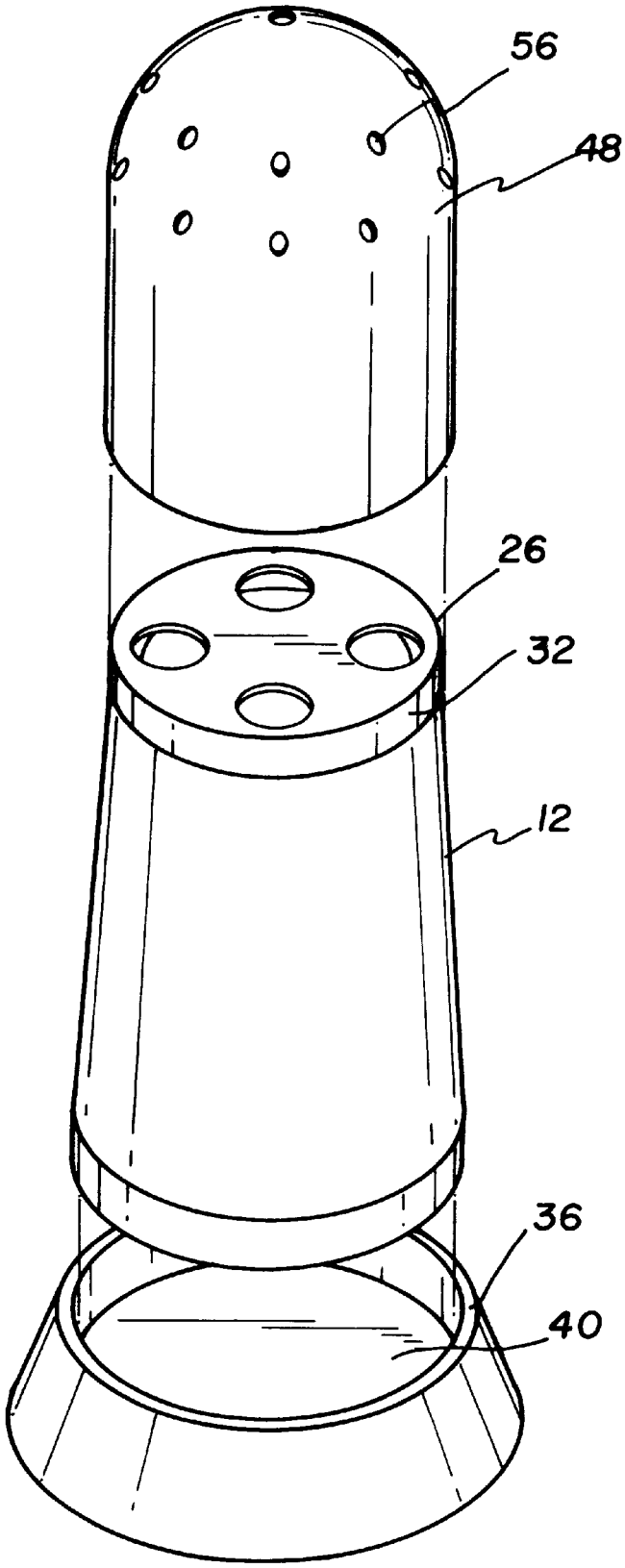
FIG. 5 is a schematic expanded perspective view of the present invention.
Figure 6:
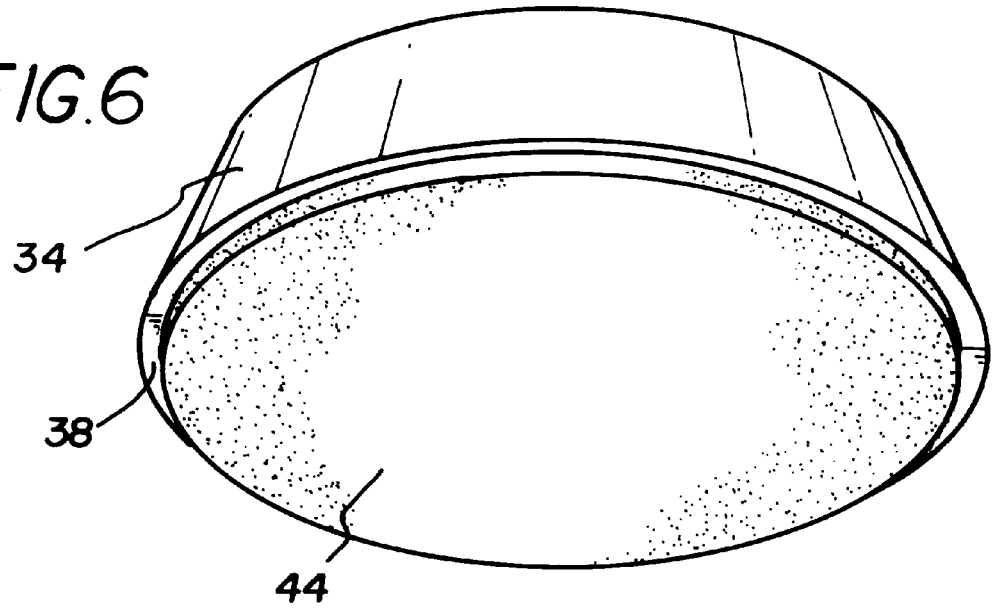
FIG. 6 is a schematic bottom view of the present invention.

With reference now to the drawings, and in particular to FIGS. 1 through 8 thereof, a new toothbrush holding device embodying the principles and concepts of the present invention and generally designated by the reference numeral 10 will be described.

As best illustrated in FIGS. 1 through 8, the toothbrush holding device 10 generally comprises a housing 12. The housing 12 has a bottom wall 14. The bottom wall 14 has a peripheral edge. A peripheral wall 16 is integrally coupled to and extends upwardly away from the peripheral edge. The peripheral wall 16 has a top edge 18 that defines an opening in the housing 12. The peripheral wall 18 has an inner surface 20 and an exterior surface 22. The housing 12 has a generally circular cross-section taken transverse to a line perpendicular to and extending through the bottom wall 14. The peripheral wall 16 is tapered such that the top edge 18 has a diameter length less than a diameter length of the bottom wall 14. FIG. 4 shows a bottom wall 14 which is removably coupled from the housing 12.

A cover member covers 26 the housing 12. The cover member 26 has a plate 28 having a peripheral edge. The plate 28 has a plurality of bores 30 therein. The peripheral edge has a lip 32 thereon, which extends away from the plate 28. The lip 32 has an exterior surface having a shoulder 34 thereon. The shoulder has a size adapted to be butted against the internal surface 20 of the peripheral wall of the housing. The plate 28 is generally planar and has a size generally equal to the opening in the housing 12.

A base member 35 has a top side 36 and a bottom side 38. The top 36 and bottom 38 sides are generally planar. The top side 36 has a slot 40 therein which has a generally annular shape. The slot 40 has a size adapted for receiving the bottom wall 14 of the housing 12. The base member 35 has a generally frusto-conical shape. The top side 36 has a smaller size than the bottom side 38. The base member 34 comprises a metal. The base member has a coating 42 thereon, which preferably comprises a plastic.

Figure 7:
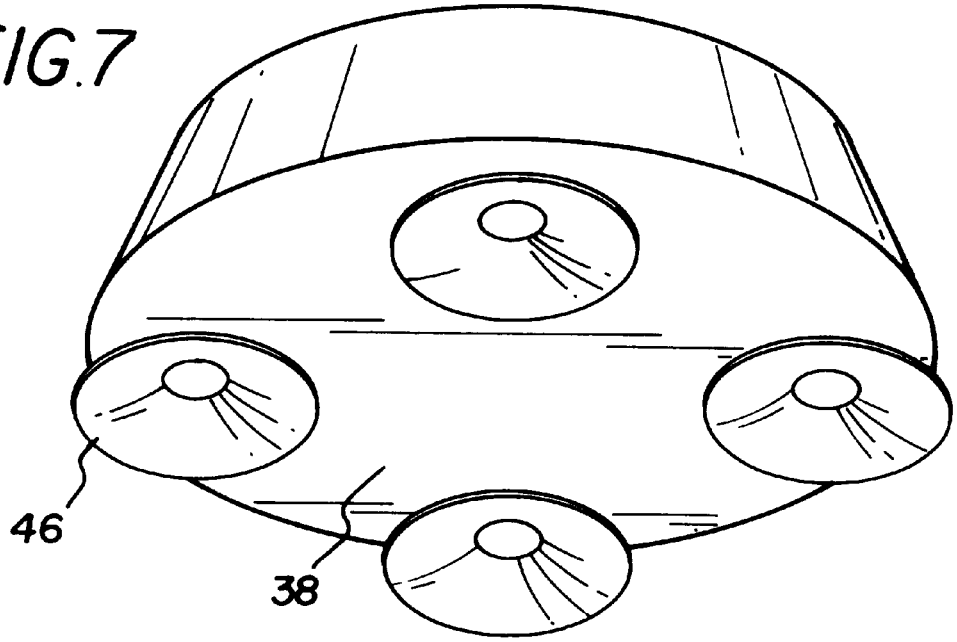
FIG. 7 is a schematic bottom view of alternative bottom for the present invention.

A sole 44 resists movement of the base member 35 on a surface. The sole 44 is fixedly coupled to the bottom side 38 of the base member 35. The sole 44 is generally disc-shaped, and ideally comprises an elastomeric material. FIG. 7 shows suction-cups 46, which may be used in the place of a sole.

Figure 8:
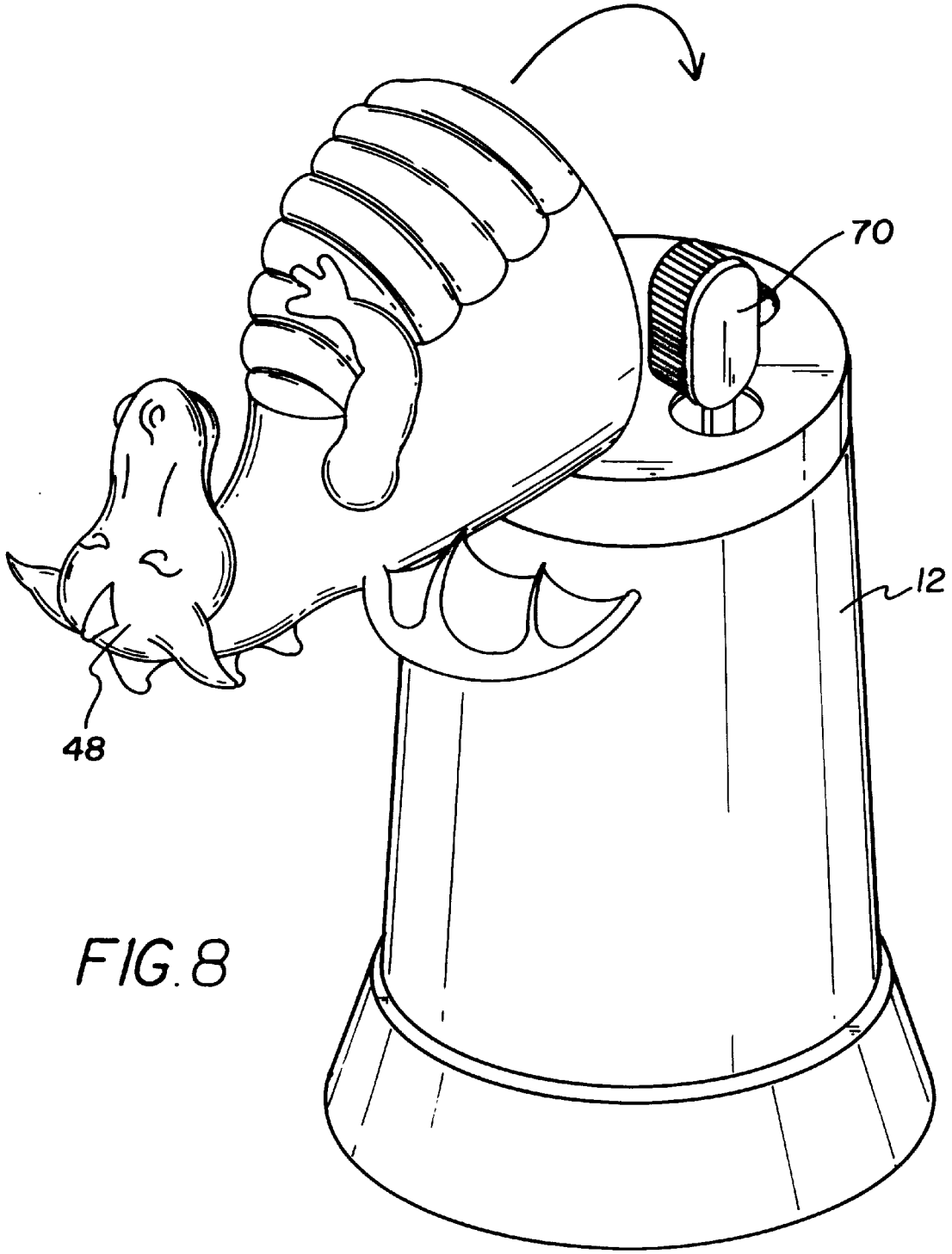
FIG. 8 is a schematic perspective view of a hinged cover member of the present invention.

A lid member 48 covers the cover member 26 of the housing 12. The lid member 48 has a top wall 50, which has a side wall 52 integrally coupled thereto. The side wall 52 has a generally circular cross-section taken transverse to a line intersecting and perpendicular to the top wall 50. The side wall 52 has a free edge 54 having a size adapted to fit over the cover member 26. The top wall 50 of the lid member 48 has a generally convex shape. The top wall 50 has a plurality of apertures 56 therein. FIG. 8 shows a lid member 48 which is hingedly coupled to the housing.

In use, toothbrushes 70 are placed in the bores 30 in the cover member 26. The lid member 48 covers the toothbrushes 70 but allows air to reach the toothbrushes so that they can dry while being kept out of sight. The base member 35 keeps the housing 12 steady and the sole 44 prevents the housing from sliding off the surface on which it is placed. The cover member 26, or the bottom wall 14 in FIG. 4, may be removed to release any water that may be trapped in the housing 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothbrush holding device, said device comprising:

a housing, said housing having a bottom wall, said bottom wall having a peripheral edge, a peripheral wall being integrally coupled to and extending upwardly from said peripheral edge, said peripheral wall having a top edge;

a cover member for covering said housing, said cover member having a plate having a peripheral edge, said plate having a plurality of bores therein, said peripheral edge having a lip thereon adapted for removably coupling to said top edge of said peripheral walls;

a base member, said base member having a top side and a bottom side, said top and bottom sides being generally planar, said top side having a slot therein, said slot having a generally annular shape, said slot having a size adapted for receiving said bottom wall of said housing;

said base member having a generally frusto-conical shape, said top side having a smaller size than said bottom side; and said base member comprising a metal, said base member having a coating thereon, said coating comprising a plastic.

2. The toothbrush holding device as in claim 1, wherein said housing has a generally circular cross-section taken transverse to a line perpendicular to and extending through said bottom wall, said peripheral wall being tapered such that said top edge having a diameter having a length less than a length of a diameter of said bottom wall.

3. The toothbrush holding device as in claim 1, wherein said lip on said plate has an exterior surface having an annular shoulder therein, said annular shoulder having a size adapted to being abutted against an interior surface of said peripheral wall of said housing, said plate being generally planar and having a size generally equal to an opening defined by said top edge in said housing.

4. The toothbrush holding device as in claim 1, further comprising:

a sole for resisting movement of said base member on a surface, said sole being fixedly coupled to said bottom side of said base member, said sole being generally disc-shaped.

5. The toothbrush holding device as in claim 4, further comprising:

a lid member for covering said cover member of said housing, said lid member having a top wall, said top wall having a side wall integrally coupled thereto, said side wall having a generally circular cross-section taken transverse to a line intersecting and perpendicular to said top wall, said side wall having a free edge having a size adapted to fit over said cover member, said top wall a plurality of apertures therein.

6. The toothbrush holding device as in claim 1, further comprising: a lid member for covering said cover member of said housing, said lid member having a top wall, said top wall having a side wall integrally coupled thereto, said side wall having a generally circular cross-section taken transverse to a line intersecting and perpendicular to said top wall, said side wall having a free edge having a size adapted to fit over said cover member, said top wall a plurality of apertures therein.

7. A toothbrush holding device, said device comprising:

a housing, said housing having a bottom wall, said bottom wall having a peripheral edge, a peripheral wall being integrally coupled to and extending upwardly away from said peripheral edge, said peripheral wall having a top edge, said top edge defining an opening in said housing, said peripheral wall having an inner surface and an exterior surface, said housing having a generally circular cross-section taken transverse to a line perpendicular to and extending through said bottom wall, said peripheral wall being tapered such that said top edge having a diameter having a length less than a length of a diameter of said bottom wall;

a cover member for covering said housing, said cover member having a plate having a peripheral edge, said plate having a plurality of bores therein, said peripheral edge having a lip thereon, said lip extending away from said plate, said lip having an exterior surface having an annular shoulder therein, said annular shoulder having a size adapted for being abutted against said inner surface of said peripheral wall, said plate being generally planar and having a size generally equal to said opening in said housing;

a base member, said base member having a top side and a bottom side, said top and bottom sides being generally planar, said top side having a slot therein, said slot having a generally annular shape, said slot having a size adapted for receiving said bottom wall of said housing, said base member having a generally frusto-conical shape, said top side having a smaller size than said bottom side, said base member comprising a metal, said base member having a coating thereon, said coating comprising a plastic;

a sole for resisting movement of said base member on a surface, said sole being fixedly coupled to said bottom side of said base member, said sole being generally disc-shaped, said sole comprising an elastomeric material; and a lid member for covering said cover member of said housing, said lid member having a top wall, said top wall having a side wall integrally coupled thereto, said side wall having a generally circular cross-section taken transverse to a line intersecting and perpendicular to said top wall, said side wall having a free edge having a size adapted to fit over said cover member, said top wall of said lid member having a generally convex shape, said top wall a plurality of apertures therein.

8. A toothbrush holding device, said device comprising:

a housing having a bottom wall and a peripheral wall being integrally coupled to and extending upwardly from said bottom wall, said peripheral wall having a top edge;

a cover member for covering said housing, said cover member having a plate having a peripheral edge, said plate having a plurality of bores therein, said peripheral edge having a lip thereon adapted for removably coupling to said top edge of said peripheral wall of said housing;

a base member having a top side and a bottom side, said top side having a slot therein adapted for receiving said bottom wall of said housing;

said base member having a generally frusto-conical shape; and said base member comprising a metal, said base member having a coating thereon, said coating comprising a plastic.

* * * * *